US005394597A

United States Patent [19]

White

[11] Patent Number: 5,394,597

[45] Date of Patent: Mar. 7, 1995

[54] METHOD FOR MAKING HIGH VELOCITY PROJECTILES

[76] Inventor: John C. White, 105 Laurel, Silsbee, Tex. 77656

[21] Appl. No.: 116,029

[22] Filed: Sep. 2, 1993

[51] Int. Cl.[6] ..... B21K 21/06

[52] U.S. Cl. ..... 29/1.23; 29/1.22; 29/422; 102/514; 102/516

[58] Field of Search ..... 29/1.2, 1.21, 1.22, 29/1.23, 422; 102/514, 516, 517

[56] References Cited

U.S. PATENT DOCUMENTS

| | | | |
|---|---|---|---|
| 338,191 | 3/1886 | Rubin . | |
| 867,508 | 10/1907 | Holland et al. . | |
| 998,307 | 7/1911 | Schouboe . | |
| 1,053,844 | 2/1913 | Mauser . | |
| 1,053,845 | 2/1913 | Mauser . | |
| 1,059,213 | 4/1913 | Ross . | |
| 1,141,783 | 6/1915 | Dobregeansky | 102/516 |
| 1,243,857 | 10/1917 | Muenzenmaier | 102/516 |
| 1,502,925 | 7/1924 | Stone . | |
| 2,926,612 | 3/1960 | Olin . | |
| 3,357,357 | 12/1967 | Voss | 102/516 |
| 4,193,348 | 3/1980 | Halverson . | |
| 4,338,862 | 7/1982 | Kwatnoski et al. . | |
| 4,610,061 | 9/1986 | Halverson . | |
| 5,189,252 | 2/1993 | Huffman et al. . | |

OTHER PUBLICATIONS

Corbin Mfg. & Supply, Inc. (White City, Oreg.) advertising flyer, "Corbin TM Questions About Swaging?" (date unknown).

The Gun Box (West Monroe, La.) booklet, "The Mity--Mite Bullet Swage System" (date unknown).

D. R. Corbin, "Handbook of Bullet Swaging No. 7, " Corbin Manufacturing & Supply, Inc., White City, Oreg., chapters 1, 2, 7 and 17 (1986).

*Primary Examiner*—Mark Rosenbaum
*Assistant Examiner*—David P. Bryant
*Attorney, Agent, or Firm*—Vaden, Eickenroht, Thompson, Boulware & Feather

[57] ABSTRACT

A lighter and faster bullet with a copper jacket and an aluminum core which is formed by first folding or rolling sheets of a thin metal such as aluminum foil into a cylinder and then inserting the cylinder into the jacket. The cylinder is then compressed within the bullet jacket without damaging the jacket by means of a bullet press. To increase the weight of the projectile, lead or other metals of different specific gravities are added to the jacket prior to insertion of the cylinder and compression.

7 Claims, 1 Drawing Sheet

METHOD FOR MAKING HIGH VELOCITY PROJECTILES

BACKGROUND OF THE INVENTION

This invention relates to a projectile for use in virtually any firearm, and, in particular, a projectile which is designed to achieve a higher velocity and flatter trajectory, and therefore, increased transference of energy to the target and accuracy over both long and short ranges.

As long as firearms have existed, there have been those who have made and experimented in the manufacture of bullets and projectiles. The jacketed projectile, because it is comprised of at least two elements, the jacket and the core, has undergone a substantial amount of this experimentation. Over the years, enthusiasts and commercial manufacturers have combined various substances in the manufacture of projectiles including wood, plastics, and metals, with further variations based on different types of metals having varying degrees of hardness, specific gravity, and mass. For instance, U.S. Pat. No. 867,508 discloses a projectile composed of a hard outer casing with an inner core composed of a softer metal oriented to the rear of the core and a lighter substance such as wood located in the nose of the core. Further U.S. Pat. No. 4,338,862 discloses a projectile having a low density filler in the nose portion of the core, preferably composed of plastic, to achieve a more destructive projectile with the characteristic of "tumbling" earlier in its path through the target.

The different types of metals utilized in projectile manufacturing vary from lead and copper to steel and tungsten. The velocity of a projectile of a particular size can be increased (at the same safe pressure levels) by using metals of lower specific gravity in the projectile. The benefits of greater velocity are well known in the art and, as noted above, include a flatter trajectory and greater accuracy and energy transference. The highest velocity of any projectile presently known to Applicant is that of the 220 Swift 0.22 caliber bullet having a calculated velocity (at the muzzle) of 4110 feet per second; actual velocity is somewhat less.

There are, however, limitations that restrict one from utilizing the lightest metal, e.g., the metal with the lowest specific gravity, available for bullets. Historically, the problem has been one of selecting a metal of sufficiently low specific gravity while maintaining a sufficient degree of hardness. Nevertheless, in spite of its relatively high specific gravity, lead is most commonly used as the core material because of its ductility, e.g., its ability to be formed by application of pressure, which enables the lead to move and assume a particular shape as the jacket and core move through the different steps of making the bullet. Without sufficient movement of the core in the jacket, the projectile may not form properly during manufacture or may fail to maintain the proper configuration prior to or after firing. For instance, the relatively soft metal copper, which is almost universally utilized as the bullet jacket, is easily deformed during the manufacturing process when a relatively harder metal, such as aluminum, is implanted into the jacket in a solid form. Consequently, if it is desired to use a core made from a metal which is harder than copper, the core must be pre-formed for insertion into the copper jacket.

The bullet of the present invention, however, overcomes this relative hardness problem and provides a bullet which, depending on the particular powder utilized, has an actual (measured) velocity (4300 f.p.s.) which is higher than that of the muzzle velocity of the above-described 220 Swift 0.22 caliber bullet and in the larger 0.30 caliber (30-06). In another experiment, a bullet made in accordance with the present invention was fired from a 0.357 magnum hand gun with a measured velocity of 2600 ft/sec (normal velocity is about 1200 ft/sec), with increased accuracy, without any indication of pressure problems, and with reduced recoil. The present invention provides a method of forming the metal core of the bullet, even for metals which are harder than the copper jacket, without the need for melting the metal by folding or rolling thin sheets of the metal, inserting them into the jacket, and then compressing or seating the rolled or folded metal sheet in the jacket. The result is a compressed core of the metal which is formed within the jacket by pressure without significant deformation of the jacket.

The advantages of the present invention are several. Not only are higher velocities achieved at the same safe pressure levels for a bullet of given caliber because of the reduced weight of the bullet, but so also is accuracy improved over comparable conventional lead core bullets because the reduced weight of the core allows a bullet of the same weight to be longer in length, having more bearing surface with the lands and grooves of the barrel of the firearm. Also, trajectory is improved by the aerodynamics of the longer bullet and the more pointed nose, or greater ogive, compared to that of conventional bullets of the same weight and having a lead core. Further, energy transference is greater on impact than that of known, conventional lead core bullets because of the higher velocity achieved over the same surface area at point of impact.

SUMMARY OF THE INVENTION

These advantages are achieved by providing a light weight, high velocity projectile comprised of a metal jacket and a core of compressed aluminum foil sheets within the jacket. The projectiles of this invention are manufactured in a broad range of sizes and grain weights by using different ratios and amounts of aluminum, lead, and or other metals and are fired from most fire-arms, including both pistols and rifles.

Further, this invention provides a method for making a light weight, high velocity projectile (for a projectile having a selected weight) which includes folding sheets of a metal such as aluminum into a cylinder, inserting the cylinder formed of the metal sheets into a copper jacket, and compressing the metal within the jacket by means of a bullet press.

BRIEF DESCRIPTION OF THE DRAWINGS

The various objects and advantages of the invention will be more clearly understood through reference to the following detailed description and the accompanying drawings wherein.

DETAILED DESCRIPTION OF THE PREFERRED EMBODIMENTS

Figure 4:
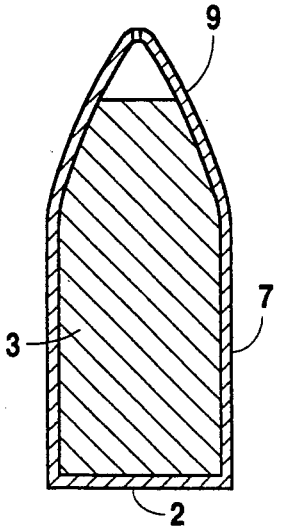
FIG. 4 shows a view of a hollow tipped projectile made in accordance with the present invention after the forming of the point thereof and with a core composed entirely of a single metal such as aluminum.

As seen in FIG. 4, the projectile of the present invention is comprised of a light-weight metal jacket 1 and a light-weight metal core 3, the latter being formed from thin metal sheets as described below. The jacket 1 is formed of a substantially planar annular base 2, a cylindrical body 7, and an arcuate frustroconical nose 9. This projectile may be of varying size to accommodate different calibered weapons.

The material used for the jacket 1 is preferably copper. The core 3 of the projectile is preferably comprised of a metal having a specific gravity that is relatively low, enabling the projectile to be fired at a high velocity along a relatively flat trajectory with greater energy transference to the target, which has been compressed in the jacket. The core 3, in a presently preferred embodiment, is comprised of compressed aluminum foil sheets, but those skilled in the art who have the benefit of this disclosure will recognize that other metals available in relatively soft alloys and in thin sheet form are also suitable for use in forming the core 3. The core 3 may also include varying amounts of lead or other metals of higher specific gravity, allowing projectiles of many grain weights to be made to suit the varying needs of the weapon owner.

More specifically, the core 3 is preferably comprised of a soft, ductile metal which has not been previously formed or otherwise worked so as to harden the metal, which is available in a thin sheet, and which has a specific gravity which is lower than the specific gravity of lead. As noted above, aluminum, purchased as aluminum foil from any manufacturer and in any grocery store, is the presently preferred metal for use in forming the core 3, but the present invention is not so limited in scope. As a general rule, almost any 1000 or 3000 series aluminum alloy that is available as a thin sheet (or combination of such alloys) is utilized to advantage in forming the core 3 in accordance with the method of the present invention. The aluminum may also be utilized in the form of an aluminum wire of a diameter sized so as to fit into the jacket of the appropriate dimensions for a particular caliber firearm.

Figure 5:
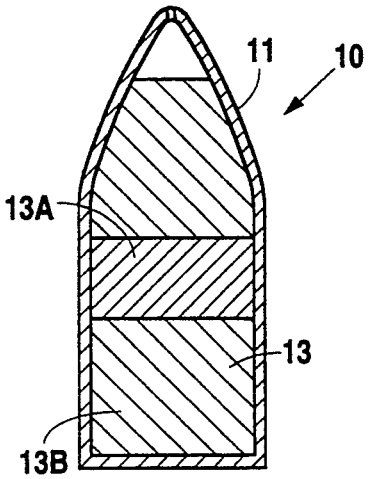
FIG. 5 shows an alternative embodiment of the hollow tipped projectile of the present invention with a core composed of a combination of two metals such as lead and aluminum.

As described below, in one aspect, the present invention provides a set of projectiles of different weights, each of the individual projectiles being comprised of a jacket 1 and core 3 formed in accordance with the method of the present invention. In so doing, the present invention has the advantage of providing, for the first time so far as is known, projectiles of different grain weights but identical exterior shape and dimension such that the weapon owner is able to use the same weapon for several different purposes. To achieve that object, a variety of metals and combinations of metals are utilized in forming the core 3. For instance, when aluminum foil is used, lead is added to the core (as shown in FIG. 5) to increase the grain weight of the projectile as described below. Using different combinations, or ratios, of lead to aluminum, the method of the present invention has been utilized to make projectiles ranging in weight (all hollow tipped, 0.30 caliber bullets of 0.308" diameter and 1.150" over all length for firing from a rifle) from 75 grain (all aluminum) up to almost 168 grain (168 grain being the weight of such a bullet having a core comprised entirely of lead).

If it is desired, for instance, to make a 125 grain bullet in accordance with the present invention, one manner in which that weight is achieved is by adding lead to the aluminum utilized in forming the core 3. That weight is also achieved by forming the core 3 from a thin sheet of a soft alloy of a metal such as zinc having a specific gravity between that of lead and that of aluminum. To make a 146 grain bullet, lead is mixed with the zinc or a metal having a specific gravity even closer to that of lead is utilized. Further, a 100 grain bullet is made by replacing a portion of the zinc (or a portion of the lead if the bullet was made with that metal) with a lighter metal, e.g., aluminum. In selecting the specific metal or combinations of metals to achieve a selected weight, the volume of metal utilized is also a pertinent consideration as addressed in more detail below.

Figure 1:
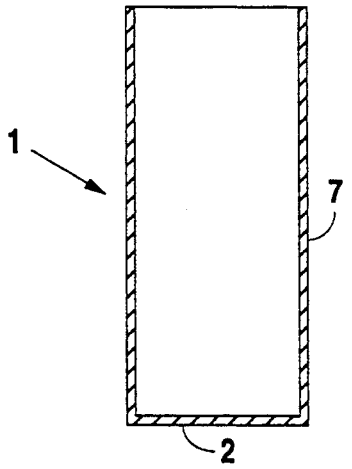
FIG. 1 is a longitudinal section through the jacket of the projectile of the present invention before forming the core therein using the method of the present invention.
Figure 2:
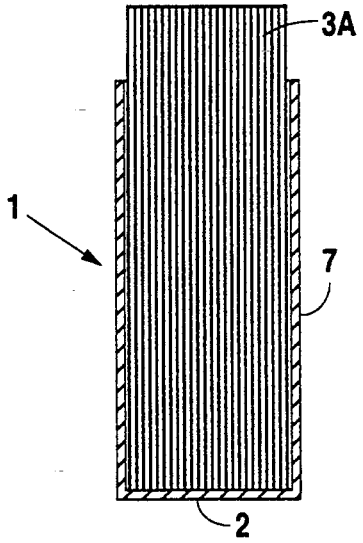
FIG. 2 shows the jacket of FIG. 1 with a cylinder comprised of a rolled or folded sheet or strip of a metal such as aluminum inserted into and extending out of the jacket.

The first step in the method for making the projectile of the present invention is selecting the appropriate size of jacket for the desired caliber of weapon. Having determined the size of the jacket, the weight of the projectile is selected for the particular purpose contemplated and, as set out above, the metals comprising the core of the projectile are selected so as to give that selected weight. In the presently preferred embodiment, strips of foil are cut from a roll of conventional aluminum foil of the type purchased at any grocery store. The cut strips of aluminum foil are then formed by rolling and/or folding into a cylindrical configuration and inserted into the copper jacket 1 so that the cylinder of folded aluminum 3A rests on the bottom 2 of the jacket 1 and the top of the cylinder 3A extends just out of the top of the jacket 1 as shown in FIG. 2.

The jacket 1 and cylinder 3A are then placed into a bullet press (not shown) and the aluminum sheets are compressed into the jacket using the "core seating" die in the press to form the core 3. A presently preferred press for use in accordance with the method of the present invention is the B.S.S.P. press (Bullet Swaging Supply, Inc., West Monroe, La.). The amount of compression applied depends in part on the strength of the operator when a hand press is utilized, but also on the caliber of the bullet, the volume of metal from which the core is formed, and the desired weight. In general, however, the compression applied ranges from about 20,000 to about 100,000 p.s.i. in the die and from about 15 to about 30 foot pounds of torque on the press handle.

Once properly seated, the top of the core 3 is recessed below the open end of the jacket 1. Other operations are then conducted as known in the art to complete the manufacture of the projectile. In a particularly preferred projectile constructed in accordance with the present invention, the jacket having the compressed core contained therein is inverted within the bullet press and the frustroconical shape of the nose and the final diameter formed using the "point forming" die (not shown) in the press, the resulting projectile being shown in FIG. 4. Although hollow tipped bullets are shown in the figure, those skilled in the art will recognize that bullets made in accordance with the present invention may also be made with a full metal jacket by sealing the hole in the jacket at the tip of the bullet.

Referring now to FIG. 5, there is shown an alternative projectile constructed in accordance with the present invention. The projectile, indicated generally at 10, is comprised of a copper jacket 11 having a core 13 comprised of layers of lead (shown at reference numeral 13A) and aluminum (13B). The lead 13A is compressed into either the bottom of jacket 11 using the setting die as described above and the rolled and/or folded aluminum cylinder placed into the jacket 11 and then compressed on top of the lead 13A (as shown in FIG. 5) or the lead is placed and compressed in jacket 11 both before and after the aluminum 13B is compressed therein.

As noted above, the amount of lead or the specific metal utilized for forming the core depends on the desired weight of the projectile. When combinations of lead and aluminum are utilized to obtain a selected weight, it is preferred that the ratio of lead to aluminum which is utilized range from about 999.99:1 (lead to aluminum) all the way up to a core which is comprised entirely of aluminum depending upon the desired performance characteristics. Those skilled in the art who have the benefit of this disclosure will also recognize that (subject to volume limitations as set out below) the weight of the projectile can be varied by increasing the number of strips of the thin sheets of metal which are rolled and/or folded so as to be formed into a cylinder and then compressed in the copper jacket. For instance, several strips of foil (all of the same metal or of different types of metal) may be laid flat, one on top of the other, before the strips are folded or rolled into the cylinder for insertion in the jacket. The number of strips utilized also affects the compression force utilized; generally, the more strips that are utilized, the larger the compressive forces needed.

As noted above, the volume of metal utilized in forming the core 3 is also a variable in making a projectile in accordance with the present invention. In the presently preferred embodiment in which aluminum foil strips are cut, rolled, and compressed in a copper jacket to form the core, experimentation has demonstrated that when a 30 caliber bullet having a overall length of 1.150" and a diameter of 0.308" is being made, the proper volume of aluminum strips can be obtained simply by adding strips approximately 1 inch by 12 inches cut from a 12 inch wide roll of aluminum foil to the pan of a balance which contains the copper jacket until a 75 grain bullet resting in the other pan of the balance is counterbalanced. However, when combinations of lead and aluminum are utilized, or when sheets of other metals are used as the sole metal comprising the core or in combination with other metals, it is generally necessary to experiment with the volume of the component metals at a desired weight by swaging several bullets and test firing. Note that addition of one metal, depending upon its ductility, generally requires a reduction in the amount of another metal utilized so as to maintain the volume of the metal in the core within acceptable limits.

Figure 3:
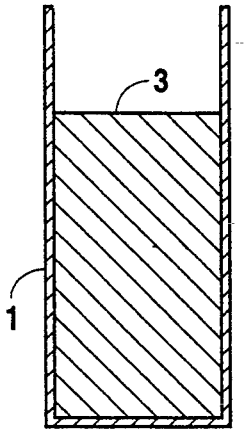
FIG. 3 shows the jacket of FIG. 1 after the cylinder of rolled or folded metal is compressed within the jacket.

Volume considerations are important because experimentation has shown that when the point of the projectile is formed as described above, the copper jacket tends to collapse, or deflect inwardly, unless inward deflection of the jacket is resisted by the presence of the compressed metal core. This resistance results from a combination of the utilization of the necessary volume of metal in the core, the amount of compression applied both to seat the metal core and to form the point, and the outward movement, or extension, of the compressed metal core when the point is formed. With regard to this latter factor, comparison of FIGS. 3 and 4 illustrates this extension of the compressed core 3 upwardly toward the point, e.g., into the frustroconical portion 9 of the bullet. Extension of the compressed core in this fashion by an amount sufficient to resist the inward deflection of the jacket during point forming cannot be achieved when an inadequate volume of metal is utilized in forming the core.

Having described the present invention in terms of the preferred embodiments which are shown in the accompanying figures, it will be recognized by those skilled in the art that certain changes can be made to the specific embodiments shown without changing the manner in which the component parts thereof function to achieve their intended result. All such changes are intended to fall within the spirit and scope of the following claims.

What is claimed is:

1. A method of manufacturing a light-weight, high velocity projectile having a metal jacket and a metal core comprising the steps of:

(a) forming a thin metal sheet into a cylindrical configuration;

(b) inserting the formed metal cylinder into a metal jacket; and (c) compressing the formed metal cylinder in the metal jacket.

2. The method of claim 1 wherein the formed metal cylinder is formed of a number of metal sheets, the number of sheets utilized depending on the desired weight of the projectile.

3. The method of claim 1 wherein the thin metal sheet which is formed into a cylindrical configuration is aluminum foil.

4. The method of claim 3 additionally comprising compressing lead in the metal jacket.

5. The method of claim 4 wherein the lead is compressed in the metal jacket before the formed metal cylinder is inserted into the metal jacket.

6. The method of claim 4 additionally comprising determining an amount of lead to be added to the metal jacket by weighing the metal sheet and the metal jacket together and adding the lead thereto in an amount which, when compressed in the metal jacket with the formed metal cylinder, brings the weight of the projectile up to a desired weight and placing the amount of lead into the jacket prior to inserting the formed metal cylinder.

7. The method of claim 1 additionally comprising forming the open end of the metal jacket into a point after compressing the formed metal cylinder.

* * * * *